US008528129B2

(12) United States Patent
Li et al.

(10) Patent No.: US 8,528,129 B2
(45) Date of Patent: Sep. 10, 2013

(54) FIXING STRUCTURE OF A FAUCET AND AN OPERATING METHOD THEREOF

(75) Inventors: Chunhung Li, Taichung (TW); Weimien Hsu, Taichung (TW); Yongjun Wu, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 365 days.

(21) Appl. No.: 12/958,114

(22) Filed: Dec. 1, 2010

(65) Prior Publication Data

US 2012/0137427 A1 Jun. 7, 2012

(51) Int. Cl.
*E03C 1/042* (2006.01)

(52) U.S. Cl.
USPC ..... 4/695

(58) Field of Classification Search
USPC ..... 4/695–696, 675–678; 137/359–360, 137/801; 239/200, 600
See application file for complete search history.

(56) References Cited

U.S. PATENT DOCUMENTS 5,535,776 A * 7/1996 Kingman ..... 137/359

* cited by examiner

*Primary Examiner* — Lori Baker

(57) ABSTRACT

A fixing structure of a faucet fixed on a support plate with an opening and contains the faucet including a housing having a mouth and a through aperture; the faucet also including an inlet pipe unit; a locking member being operated to move between an engaging position and a disengaging position along the through aperture; a positioning device including a fitting seat having a bottom face, a channel defined therein to receive the inlet pipe unit of the faucet, at least one slot disposed along an outer surface thereof to slide the locking member located at the engaging position, the slot including at least one tooth and at least one retaining recess such that the locking member passes through the tooth to be retained in the retaining recess and is limited by the tooth to move so that the mouth is fixed to the fitting seat.

19 Claims, 15 Drawing Sheets

FIXING STRUCTURE OF A FAUCET AND AN OPERATING METHOD THEREOF

BACKGROUND OF THE INVENTION

1. Field of the Invention

The present invention relates to a fixing structure of a faucet fixed on a support plate and an operating method thereof.

2. Description of the Prior Art

A conventional device for a top mounting of a faucet disclosed in U.S. Pat. No. 5,535,776 contains a fitting seat inserted into an opening of a support plate used in a kitchen equipped with a water tank, and the fitting seat includes a column with screws extending downward to the support plate and used to receive a body of the faucet, the column of the fitting seat includes a plastic pad, a spaced ring, and a metal retaining loop fitted thereon and screwed with a nut. A user applies a torque wrench to insert a screwing element into an orifice of a vertical wall of the fitting seat via a casing of the faucet to limit a relative movement between the faucet and the fitting seat, thus assembling the faucet.

However, many related components of such a conventional device for the top mounting of the faucet have to be installed below the water tank, limiting installing space and having a complicate installation.

The present invention has arisen to mitigate and/or obviate the afore-described disadvantages.

SUMMARY OF THE INVENTION

The primary object of the present invention is to provide a fixing structure of a faucet and an operating method thereof that is capable of overcoming the shortcomings of the conventional fixing structure of a faucet.

To obtain the above objectives, a fixing structure of a faucet provided by the present invention contains:

the faucet including a housing, the housing including a mouth formed on a bottom end thereof and at least one through aperture radially formed on a peripheral side of the bottom end thereof; the faucet including an inlet pipe unit connected with a bottom end of thereof and extending downward through the mouth of the housing;

a locking member being operated to move between an engaging position and a disengaging position along the through aperture;

a positioning device including a fitting seat, and the fitting seat including a bottom face to be abutted against a top wall of the opening of the support plate, a channel defined therein to receive the inlet pipe unit of the faucet, one slot disposed on least one portion of an outer surface thereof to slide the locking member of the housing located at the engaging position, the slot including at least one tooth and at least one retaining recess such that the locking member passes through the tooth to be retained in the retaining recess and is limited by the tooth to move backward so that the mouth of the housing is fixed on the fitting seat.

To obtain the above objectives, an operating method of a fixing structure of a faucet provided by the present invention contains steps of:

a. preparing, wherein a faucet, a locking member, and a positioning device are provided; wherein the faucet includes a housing, the housing includes a mouth formed on a bottom end thereof and at least one through aperture radially formed on a peripheral side of the bottom end thereof; the faucet includes an inlet pipe unit connected with a bottom end of thereof and extending downward through the mouth of the housing;

a locking member is operated to move between an engaging position and a disengaging position along the through aperture;

a positioning device includes a fitting seat, and the fitting seat including a bottom face, a channel defined therein, one slot disposed on least one portion of an outer surface thereof, the slot includes at least one tooth and at least one retaining recess;

b. installing the locking member, wherein the locking member is fixed in a through aperture of a housing so as to move between an engaging and a disengaging positions along the through aperture, thereafter the locking member is controlled to be located the engaging position;

c. positioning the positioning device, wherein a top wall of a fitting seat of the positioning device is retained on the top wall of an opening of a support plate.

d. aligning the faucet, wherein the bottom end of the housing of the faucet is aligned to the fitting seat, and the locking member is aligned with the longitudinal slot; thereafter the inlet pipe unit is inserted into the channel of the fitting seat;

e. fitting the faucet, wherein the bottom end of the housing of the faucet is slidably fitted to the fitting seat, and the locking member slides downward along the longitudinal slot to pass through the al least one tooth to retain with the retaining recess so as to pass the at least one tooth along the lateral slot to retain with one selected retaining recess, hence the locking member is limited so that it can not rotatably return to an original position, thereby positioning the faucet on the positioning device and finishing an installation of the faucet.

Thereby, the fitting seat is fitted directly during installing the faucet, thus positioning the fitting seat quickly and easily without a rotating operation.

The positioning device is capable of being operated on the support plate to position the faucet easily and quickly.

The projections are fixed around an inner surface of the fitting seat and located at the top end of the opening of the support plate to arrange the screwing elements and the engagement blocks so that a receiving space of the channel of the fitting seat are increased to insert the inlet pipe unit easily.

Because the tab is located at the middle section of the inner side of the contacting portion, the contacting portion of the engagement block is retained on the bottom wall of the support plate stably, hence the positioning device is fixed on the support plate securely.

The engagement block is comprised of the metal base and the plastic clamping piece to obtain a strong structure and a tight engaging function, such that the contacting portion contacts with the bottom wall of the support plate tightly. Also, the rib of the plastic clamping piece is applied to increase an engagement effect.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Referring to FIGS. 1-4, a fixing structure of a faucet according to a preferred embodiment of the present invention comprises a faucet 10, a locking member 20, and a positioning device 301.

The faucet 10 is fixed on a support plate 1 with an opening 1*a*, and the support plate 1 is used in a kitchen cupboard equipped with a water tank, wherein the faucet 10 is fixed on the support plate 1 of the water tank.

Figure 5:
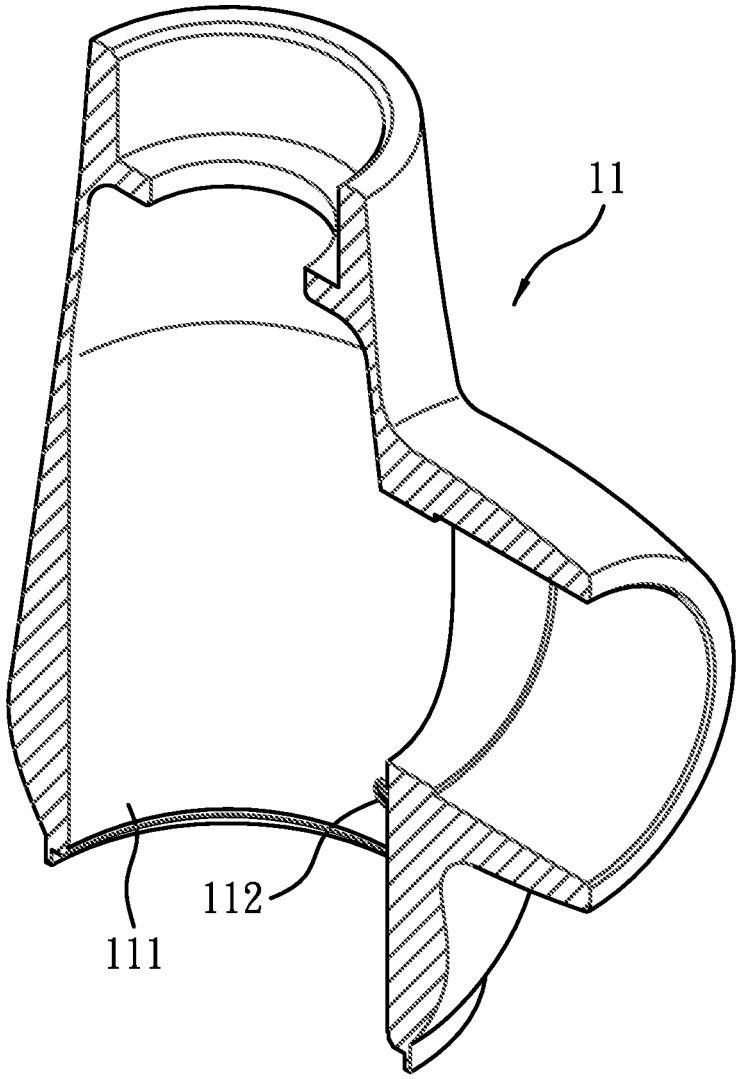
FIG. 5 is a cross-sectional perspective view of a housing of the faucet according to the preferred embodiment of the present invention.

The faucet 10 in this embodiment is a single-handle faucet and comprises a housing 11, the housing 11 includes a valve (not shown) to mix cold and hot waters together disposed therein and an operating bar 12 disposed on one side thereof to be rotated to control the valve, and the valve includes an inlet pipe unit 13 connected with a bottom end of the valve, the inlet unit 13 includes a first inlet pipe 131 to flow the cold water and a second inlet pipe 132 to flow the hot water, the housing 11 includes an outlet tube 14 connected on a top end thereof and allowing to be rotated to adjust a watering angle. The faucet 10 is a well-known prior art, so further remarks are omitted. The housing 11 includes a mouth 111 formed on a bottom end thereof and a through aperture 112 radially formed on a peripheral side of the bottom end thereof. In this embodiment, the through aperture 112 includes threads attached therein as shown in FIG. 5.

Figure 15:
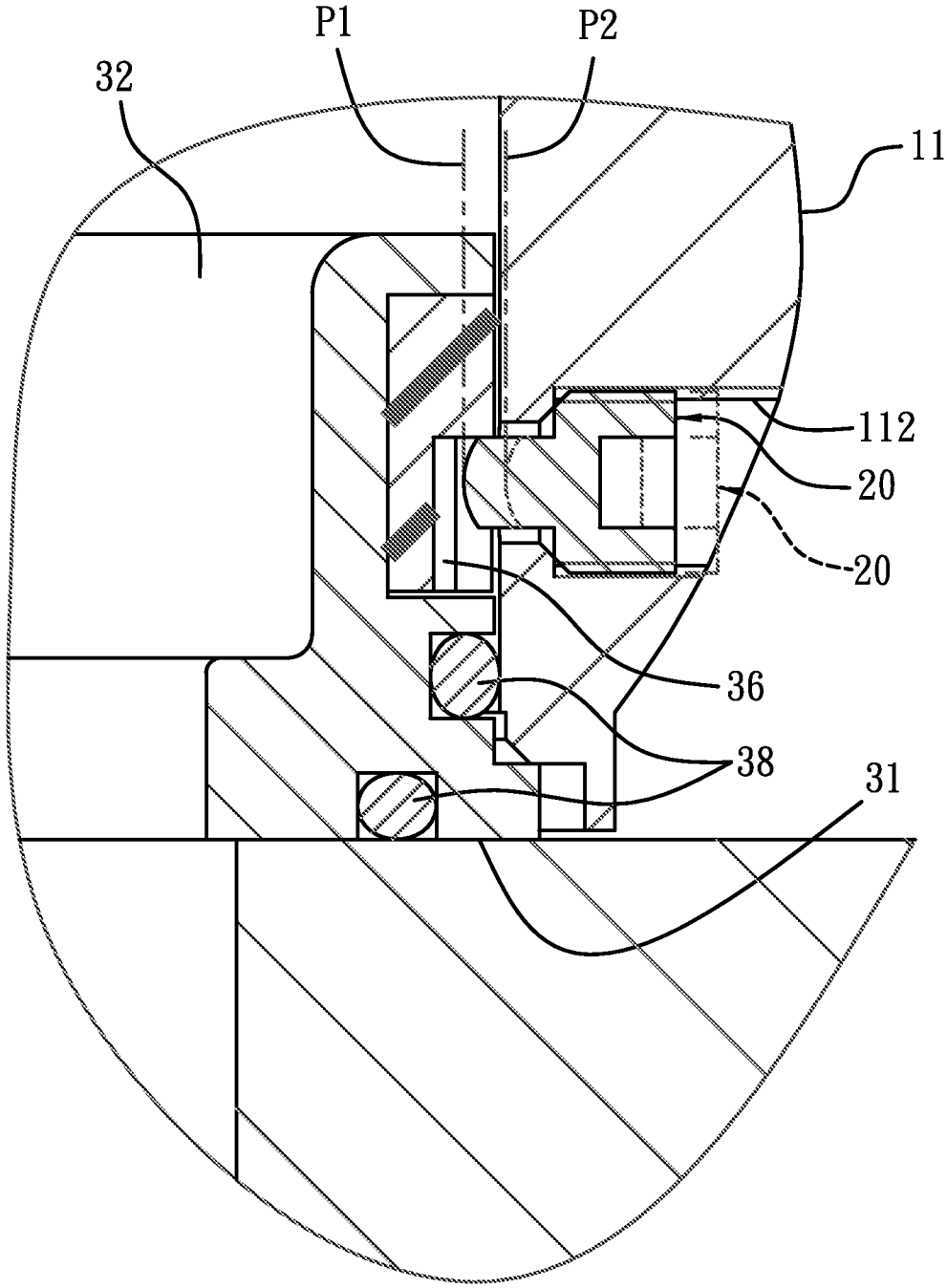
FIG. 15 is a cross sectional view showing the operation of the fixing structure of the faucet according to the preferred embodiment of the present invention.

The locking member 20 is operated to move between an engaging position P1 and a disengaging position along the through aperture 112 as illustrated in FIG. 15. In this embodiment, the locking member 20 is a screw bolt to screw with the through hole 12 and to be rotated to move between the engaging and the disengaging positions P1, P2.

Figure 6:
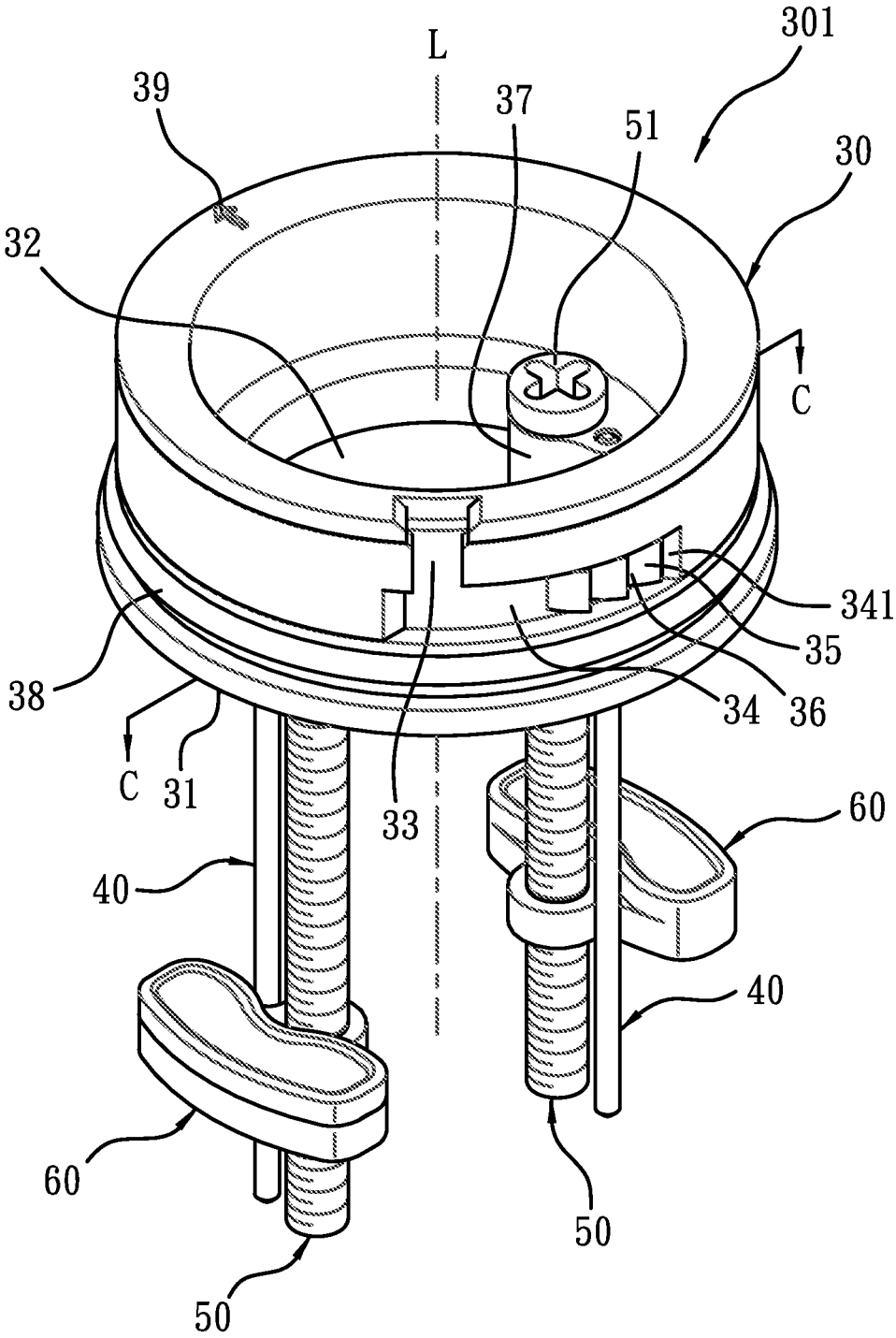
FIG. 6 is a perspective view showing the assembly of a positioning device of the fixing structure of the faucet according to the preferred embodiment of the present invention.

As illustrated in FIG. 6, the positioning device 301 includes a fitting seat 30, two limiting rods 40, two screwing elements 50, and two engagement blocks 60.

Figure 7:
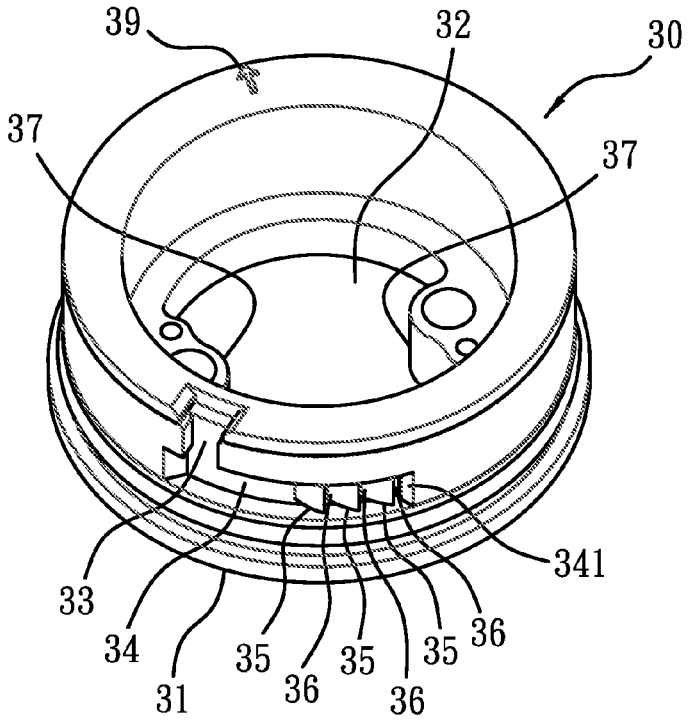
FIG. 7 is a perspective view showing the assembly of a fitting seat of the fixing structure of the faucet according to the preferred embodiment of the present invention.

Referring to FIG. 7, the fitting seat 30 includes a bottom face 31 to be abutted against a top wall 1*b* of the opening 1*a* of the support plate 1, includes a channel 32 defined therein to receive the inlet pipe unit 13 of the faucet 10, includes a longitudinal slot 33 disposed on and extending axially along an outer surface thereof, and a lateral slot 34 extending along a circumferential direction thereof to communicate with the longitudinal slot 33, the lateral slot 34 includes three teeth 35 arranged therein, between any two adjacent teeth 35 is defined a retaining recess 36, and between a rearmost tooth 35 and a first fence 341 of a distal end of the lateral slot 34 is defined one retaining recess 36 as well, there are three retaining recesses 36 defined in this embodiment to be selected to retain with the locking member 20.

Figure 8:
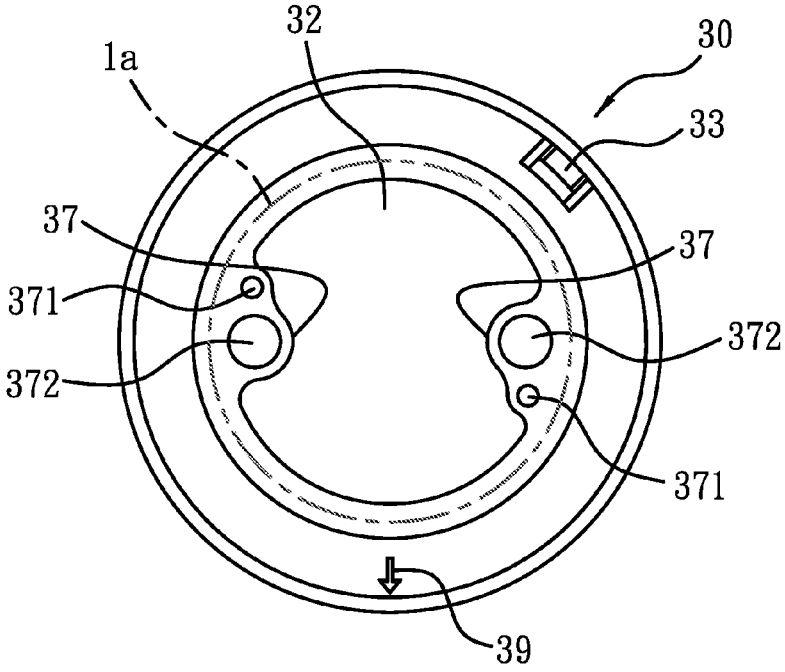
FIG. 8 is a top plan view showing the assembly of the fitting seat of the fixing structure of the faucet according to the preferred embodiment of the present invention.

The fitting seat 30 includes two opposite projections 37 fixed around an inner surface thereof and located at a top end of the opening 1*a* of the support plate 1 as shown in FIG. 8.

Figure 1:
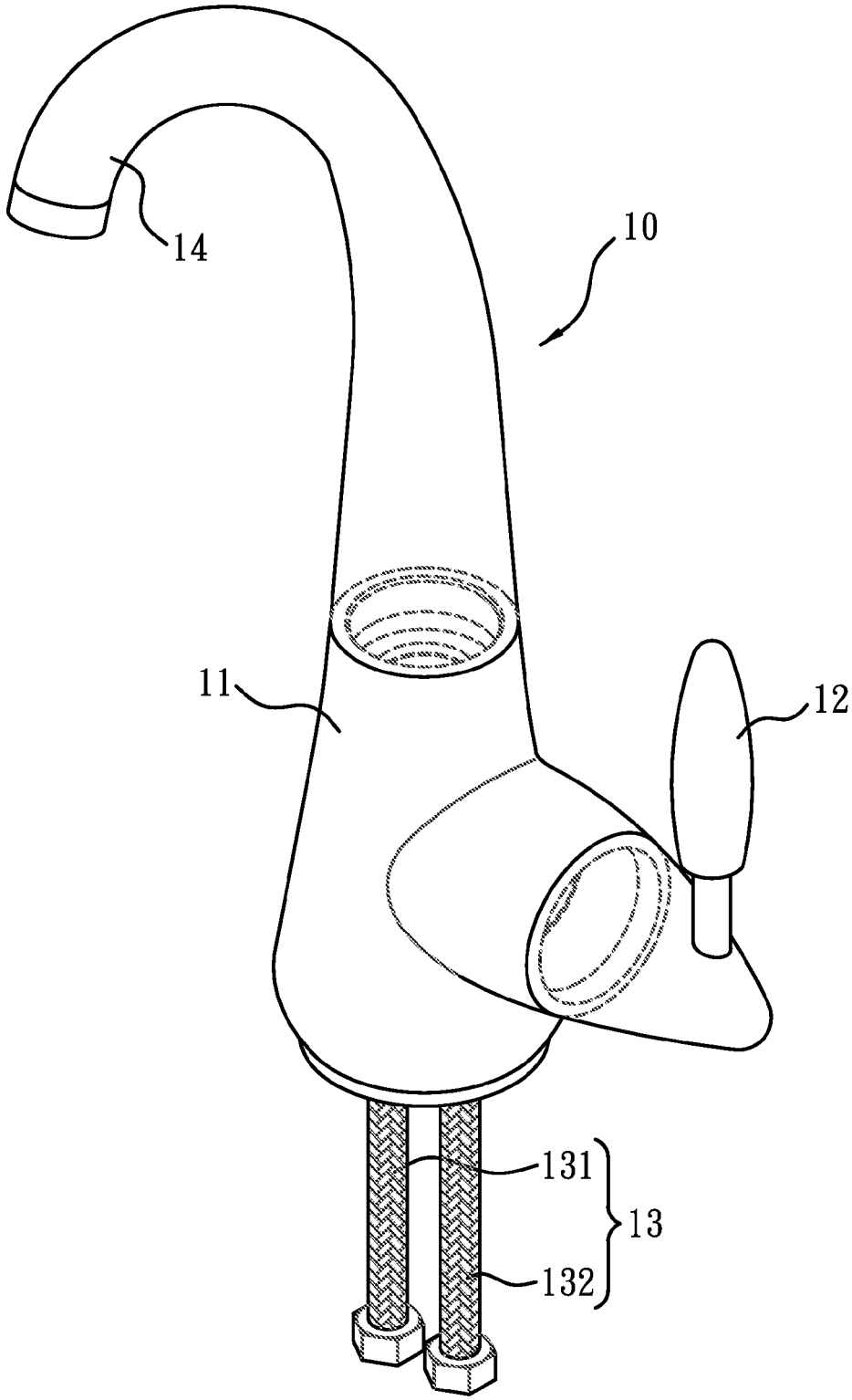
FIG. 1 is a perspective view showing the assembly of a faucet according to a preferred embodiment of the present invention.
Figure 2:
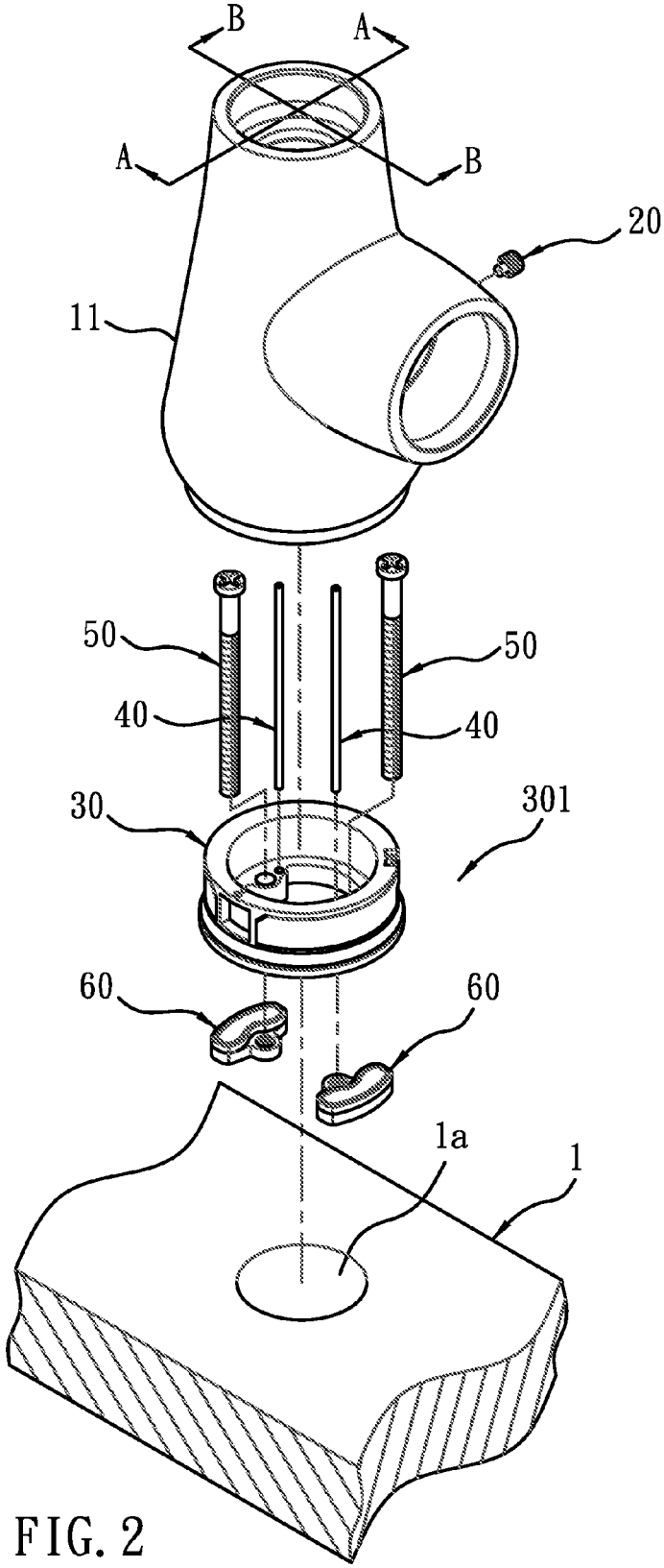
FIG. 2 is a perspective view showing partial exploded components of a fixing structure of the faucet according to the preferred embodiment of the present invention.
Figure 3:
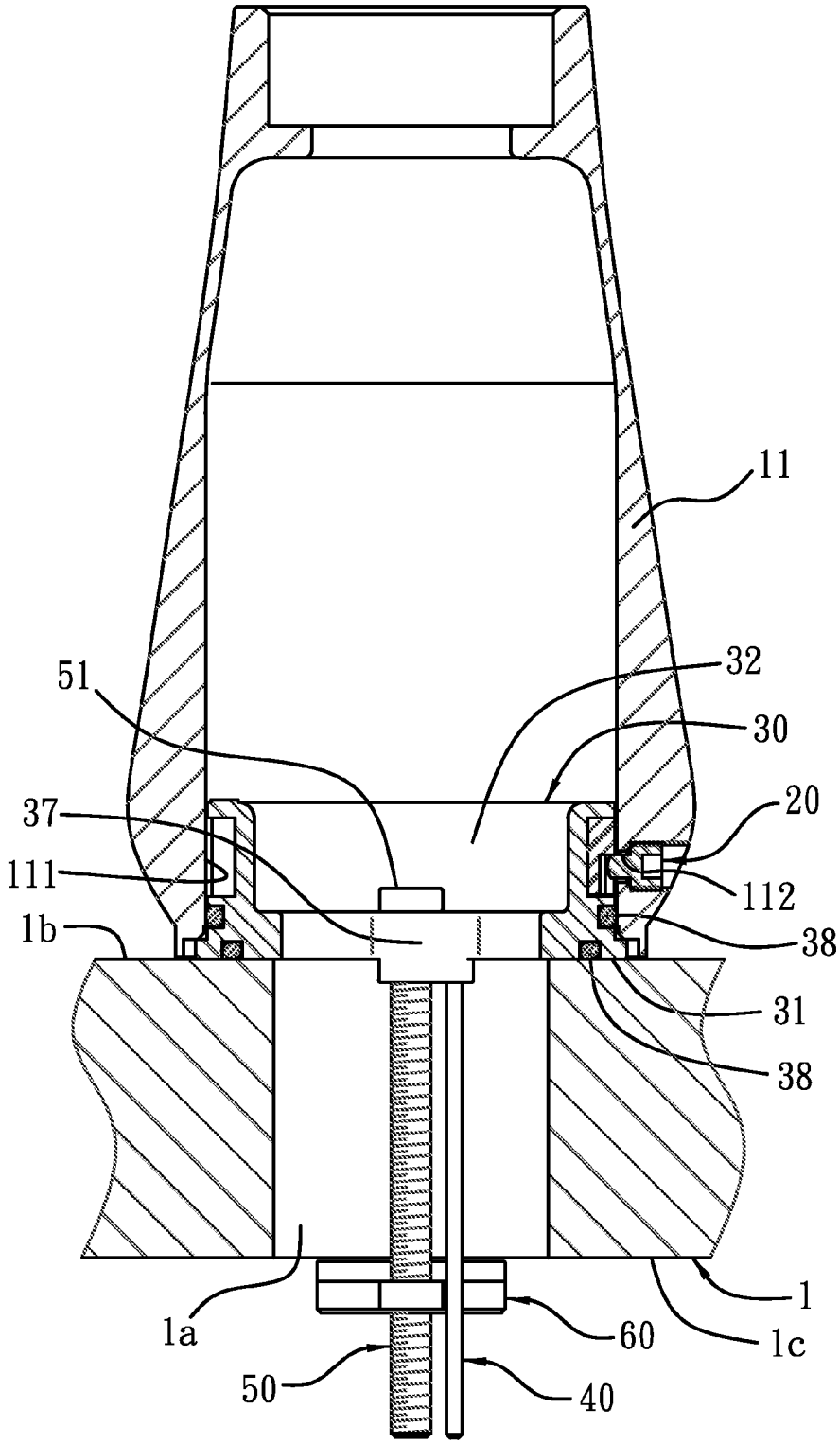
FIG. 3 is a cross sectional view taken along the line A-A of FIG. 2.
Figure 4:
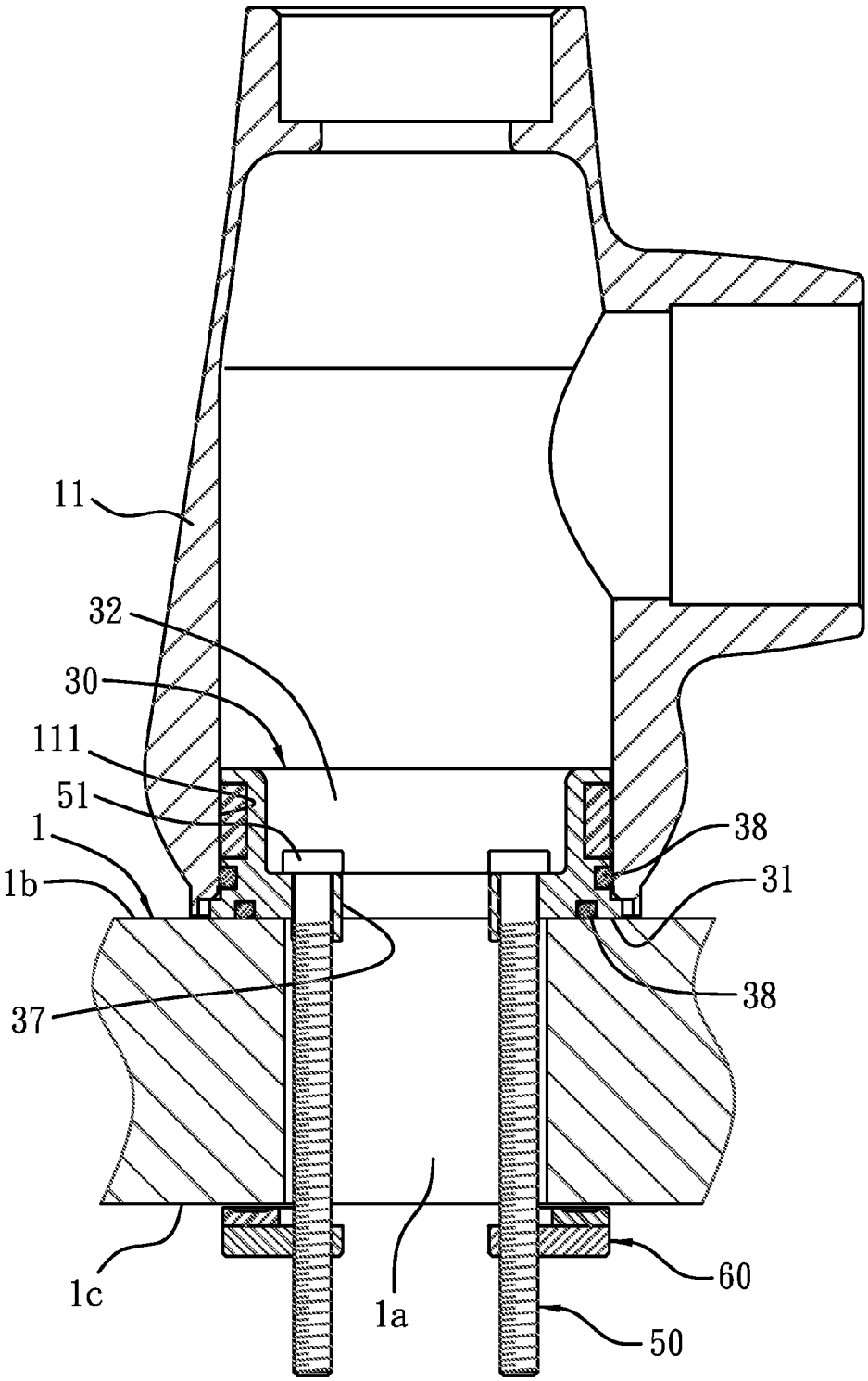
FIG. 4 is a cross sectional view taken along the line B-B of FIG. 2.

The fitting seat 30 further includes two sealing pads 38 attached on the outer and the bottom surfaces thereof individually as illustrated in FIGS. 3 and 4 to engage with an inner surface of the mouth 111 and the top wall 1*b* of the opening 1*a* of the support plate 1.

The fitting seat 30 includes a direction remaking element 39 arranged on a top end thereof to guide an installation in a circumferential direction of the fitting seat 30. In this embodiment, the direction remaking element 39 is formed in an arrow shape.

Figure 13:
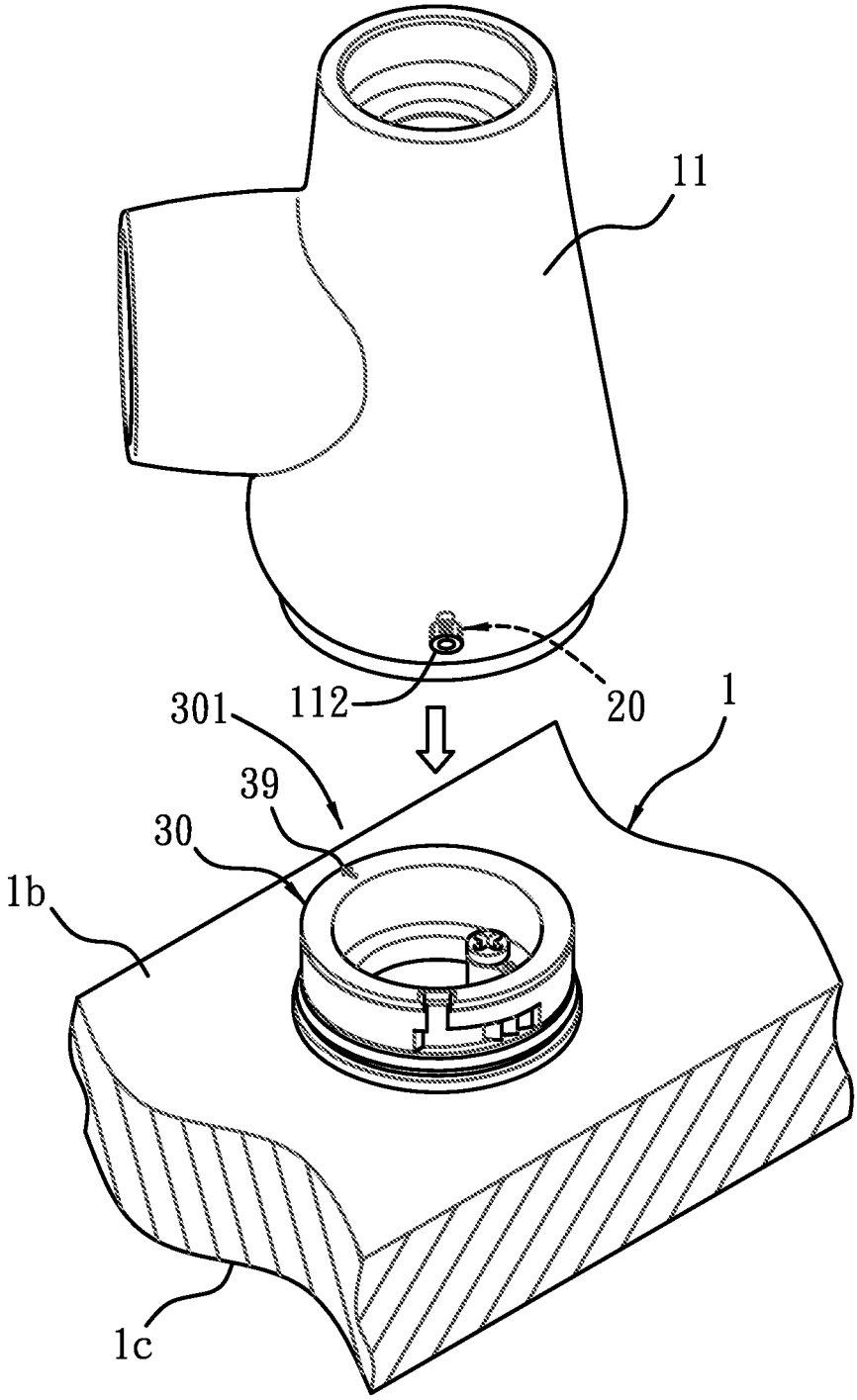
FIG. 13 is a perspective view showing the operation of the fixing structure of the faucet according to the preferred embodiment of the present invention.
Figure 14:
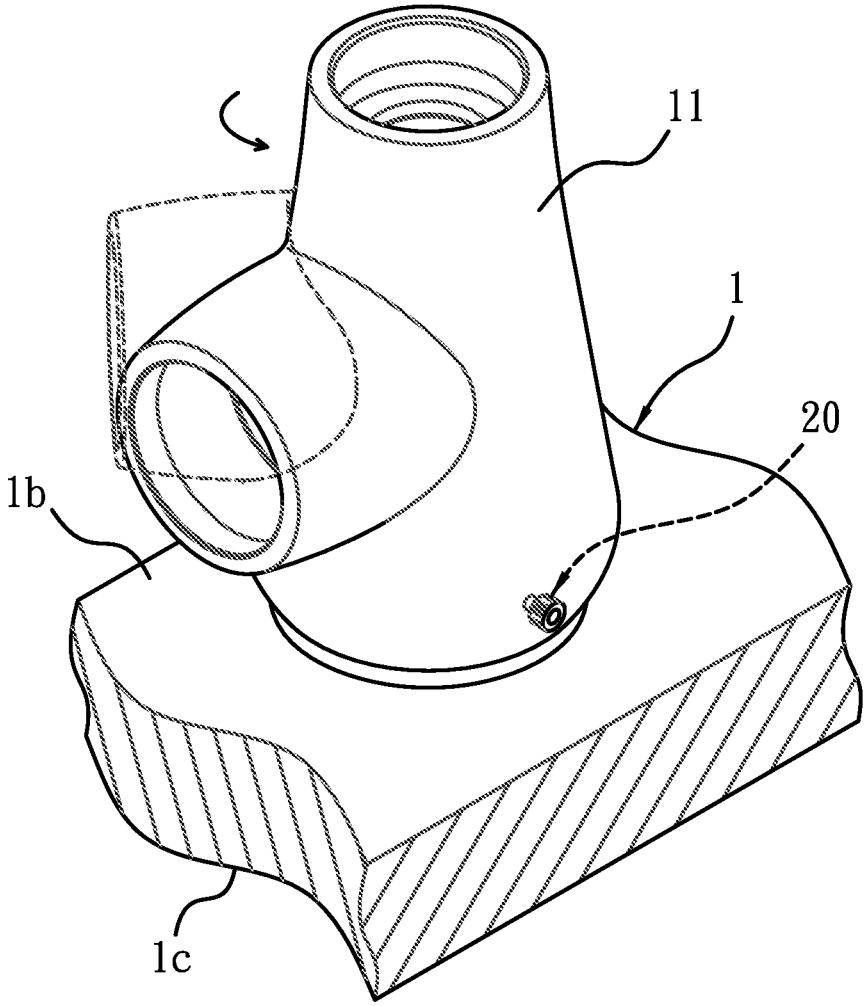
FIG. 14 is another perspective view showing the operation of the fixing structure of the faucet according to the preferred embodiment of the present invention.

The fitting seat 30 is provided to receive the housing 11, and in operation, the locking member 20 located at the engaging position P1 of the housing 11 is aligned with the longitudinal slot 33 of the fitting seat 30, and then it is fitted to the fitting seat 30 by using the mouth 111 as shown in FIG. 13, so that the locking member 20 slides downward to a terminal position of a lower side of the housing 11 along the longitudinal slot 33, thereafter the housing 11 is rotated so that the locking member 20 further slides along the lateral slot 34, such that the locking member 20 passes through at least one tooth 35 to engage with one of the retaining recesses 36. Of course, the housing 11 is capable of being further rotated so that the locking member 20 engages with another retaining recess 36, hence the housing 11 is fixed on the positioning device 301 securely as shown in FIG. 14.

Figure 9:
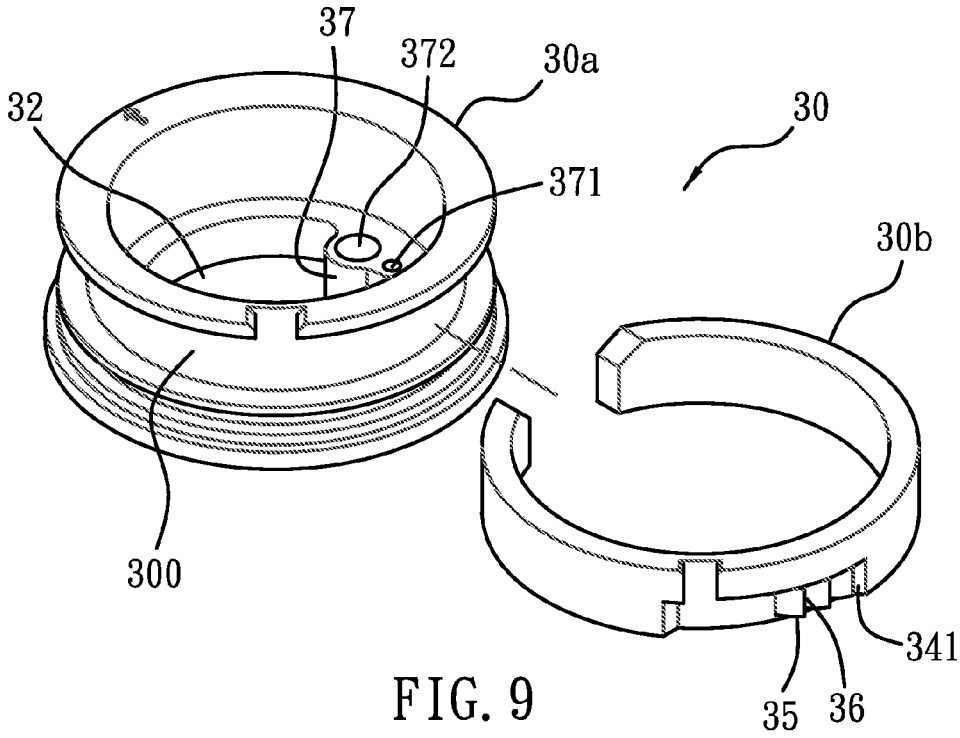
FIG. 9 is a perspective view showing the exploded components of the fitting seat of the fixing structure of the faucet according to the preferred embodiment of the present invention.

To generate a flexible deformation of the tooth 35 of the fitting seat 30 so that the locking member 20 enters into a predetermined retaining recess 36, and the fitting seat 30 has a strong structure as illustrated in FIGS. 7 and 9, a first component 30*a* made of a hard material and a second component 30*b* made of a plastic material are pre-formed, wherein the second component 30*b* is formed in a C-shaped ring shape so as to be retained in a C-shaped groove 300 pre-formed on an outer surface of the first component 30*a*, thus forming the fitting seat 30; wherein the first component 30*a* is made of a hard material, such as a metal material, to generate a main part of the fitting seat 30, enhancing a structural reinforcement of the fitting seat 30, such as the projections 37. The second component 30*b* is used to form main parts of the longitudinal slot 33 and the lateral slot 34, such as the teeth 35 of the lateral slot 34 to cause a flexible deformation.

The two limiting rods 40, as shown in FIG. 6, are parallel to each other and connected to the projections 37 of the fitting seat 30, and a distal end of each limiting rod 40 extends downward to a bottom end of the support plate 1 via the channel 32. In this embodiment, the limiting rod 40 is retained in a first bore 371 of the projection 37 of the fitting seat 30.

Each screwing element 50, as illustrated in FIG. 6, is parallel to a centrally axial line L of the fitting seat 30, inserted into the projection 37 of the fitting seat 30, and is adjacent to the limiting rod 40, a distal end of the screwing element 50 extends downward to the bottom end of the support plate 1 via the channel 32. In this embodiment, the screwing element 50 is movably rotated to be further inserted into a second bore 372 of the projection 37, and a head end 51 of the screwing element 50 is limited above the second bore 372.

Each engagement block 60 is screwed with the screwing element 50 and engaged on a bottom wall 1*c* of the support plate 1 by using the screw element 50 and the limiting rod 40 so that the positioning device 301 is fixed on the support plate 1 stably.

Figure 10:
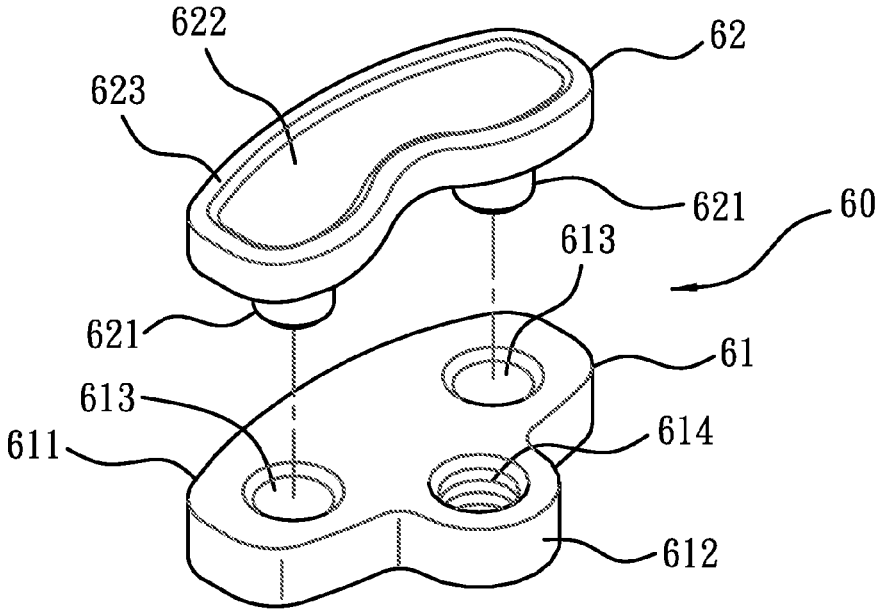
FIG. 10 is a perspective view showing the exploded components of an engagement block of the fixing structure of the faucet according to the preferred embodiment of the present invention.

With reference to FIG. 10, the engagement block 60 is comprised of a metal base 61 and a plastic clamping piece 62 connected on the metal base 61. The metal base 61 includes a contacting portion 611 and a tab 612 located at a middle section of an inner side of the contacting portion 611; the contacting portion 611 extends radially from the centrally axial line L of the fitting seat 30, and includes two first orifices 613 formed thereon to retain two posts 621 extending from a bottom end of the plastic clamping piece 62 respectively; the tab 612 includes a second orifice 614 to screw with the screwing element 50; the plastic clamping piece 62 is semilunar, and includes a notch 622 arranged on a top end thereof and a rib 623 formed around a peripheral side of the top end thereof to engage with the bottom wall 1*c* of the support plate 1.

An operating method of a fixing structure of a faucet includes steps of:

a. preparing, wherein a faucet 10, a locking member 20, and a positioning device 301 are provided;

b. installing the locking member 20, wherein the locking member 20 is fixed at an engaging position P1 of a through aperture 112 of a housing 11;

c. positioning the positioning device 301, wherein a top wall 1*b* of a fitting seat 30 of the positioning device 301 is retained on the top wall 1*b* of an opening 1*a* of a support plate 1.

Figure 11:
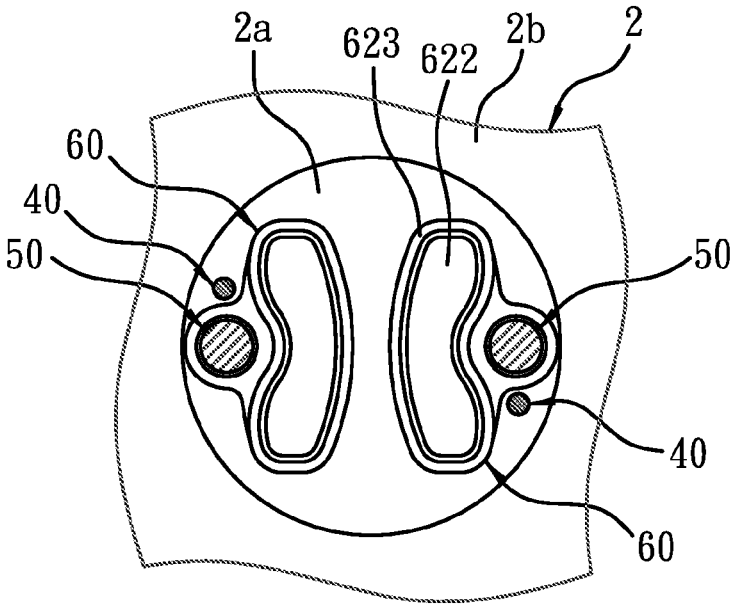
FIG. 11 is a cross sectional view taken along the line C-C of FIG. 6 and showing two engagement blocks are close to each other.
Figure 12:
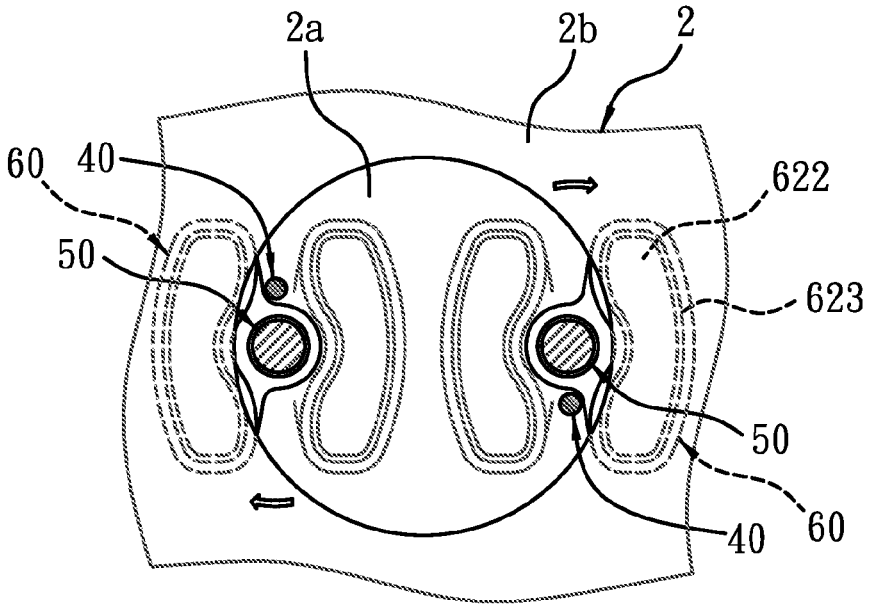
FIG. 12 is a cross sectional view showing the two engagement blocks leave away from each other.

If two engagement blocks 60 on two screwing elements 50 are not able to be inserted through an opening 1*a* of the support plate 1, the engagement blocks 60 are turned to be close to each other so that a distance between the engagement blocks 60 is lowered until the engagement blocks 60 are capable of passing through the opening 1a of the support plate 1 as illustrated in FIG. 11;

thereafter, the screwing elements 50, the engagement blocks 60, and the limiting rods 40 are inserted downward from the opening 1*a* of the support plate 1 until a bottom face 31 of the fitting seat 30 of the fixing device 301 abuts against the top wall 1*b* of the support plate 1, and then two head portions 51 of the two screwing elements 50 are individually rotated toward a predetermined direction above the fitting seat 30 by ways of a specific tool so that the adjacent engagement blocks 60 are actuated to rotate so as to leave away from each other as shown in FIG. 12, hence the engaging blocks 60 move upward along the screwing elements 50 respectively until they engage with the bottom wall 1*c* of the support plate 1;

d. aligning the faucet 10, wherein the bottom end of the housing 11 of the faucet 10 is aligned to the fitting seat 30, and the locking member 20 is aligned with the longitudinal slot 33 as shown in FIG. 13; thereafter the inlet pipe unit 13 is inserted into the channel 32 of the fitting seat 30;

e. fitting the faucet 10, wherein the bottom end of the housing 11 of the faucet 10 is slidably fitted to the fitting seat 30, and the locking member 20 slides downward along the longitudinal slot 33;

f. rotating and positioning the faucet 10, wherein the housing 11 of the faucet 11 is rotated toward a predetermined direction as illustrated in FIG. 14 so that the locking remember 20 passes the at least one tooth 35 along the lateral slot 34 to retain with one selected retaining recess 36 as shown in FIG. 3, hence the locking member 20 is limited so that it can not rotatably return to an original position, thereby positioning the faucet 10 on the positioning device 301 and finishing an installation of the faucet 10.

Figure 16:
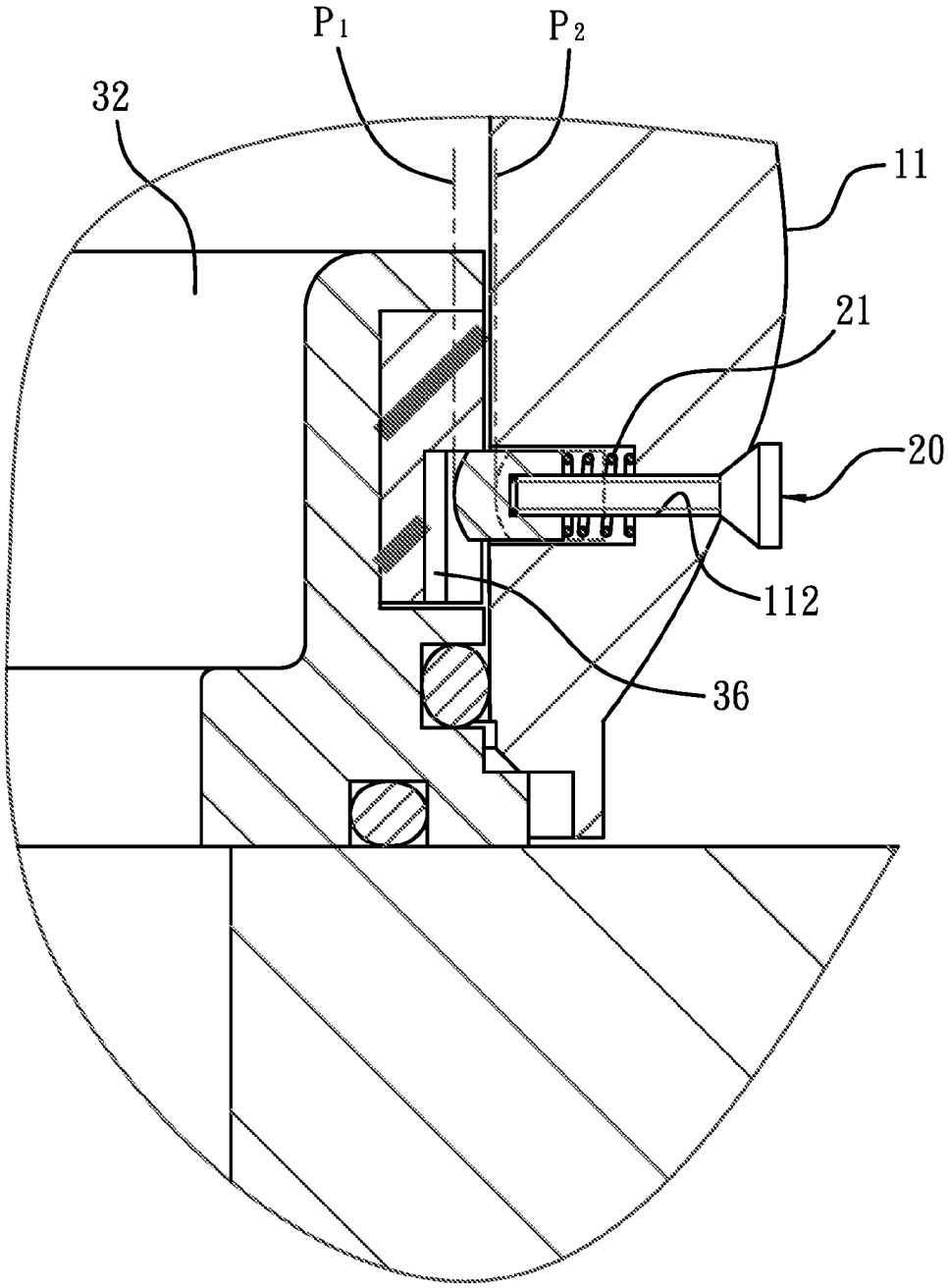
FIG. 16 is a cross sectional view showing the assembly of a locking member of a fixing structure of a faucet according to another embodiment of the present invention.

Referring to FIG. 16, the locking member 20 is a pulling shaft on which a resilient element 21 to be compressed is fitted so that the pulling shaft is acted by the resilient element 21 to be located at the engaging position P1 and is pulled outward to move toward the disengaging position P2.

The fitting seat 30 includes three retaining recess 36, and when the locking member 20 is fixed on a middle recess 36, the operating bar 12 is located at a right side of the faucet 10, and when the locking member 20 is located at the other two retaining recess 36, the operating bar 12 is located at a front end of the right side of the faucet 10 or a rear end of the right side of the faucet 10 to be adjusted by the user.

Furthermore, the fitting seat 30 of the positioning device 301 is moved forward or toward a desired installing position by using the direction remaking element 39 to be further fixed, therefore after the faucet 10 is positioned in the fitting seat 30, the operating bar 12 is located at a right side of the support plate 1 as shown in FIG. 13. Accordingly, the installation direction and position of the fitting seat 30 will determine a position of the operating bar 12 after installing the faucet 10. In other words, the position of the operating bar 12 is controlled by controlling an installing direction of the fitting seat 30.

Figure 17:
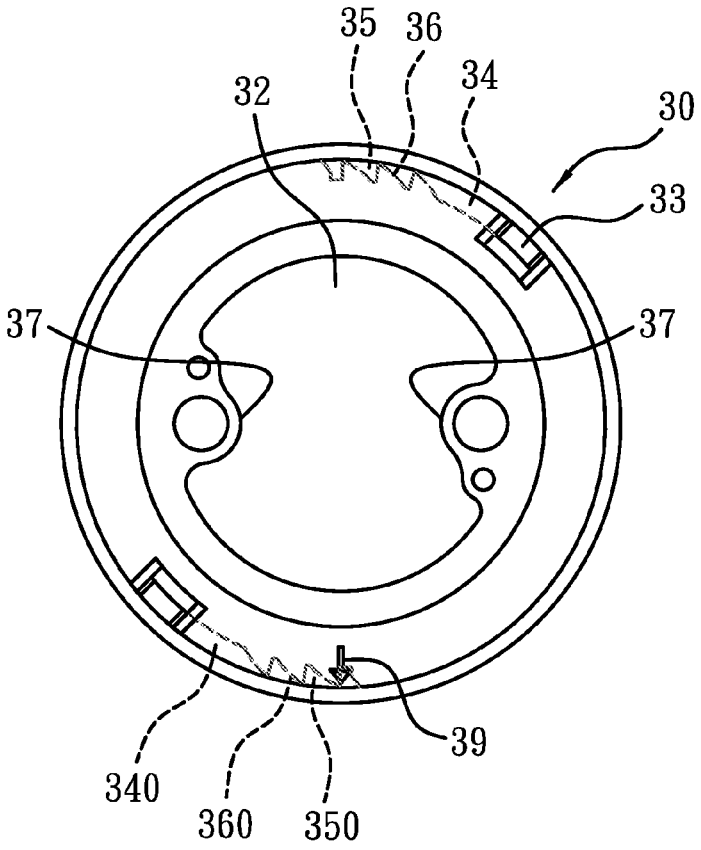
FIG. 17 is a top plan view showing the assembly of a fitting seat of a fixing structure of a faucet according to another embodiment of the present invention.

For example, if desiring to position the operating bar 12 on a left side of the support plate 1, a longitudinal slot 330, a lateral slot 340, a plurality of teeth 350, and retaining recesses 360 are provided on another end of the outer surface of the fitting seat 30 relative to the longitudinal slot 33 as shown in FIG. 17 so that the user positions the locking member 20 in any selected retaining recess 360 to locate the operating bar 12 at the left side of the support plate 1.

Figure 18:
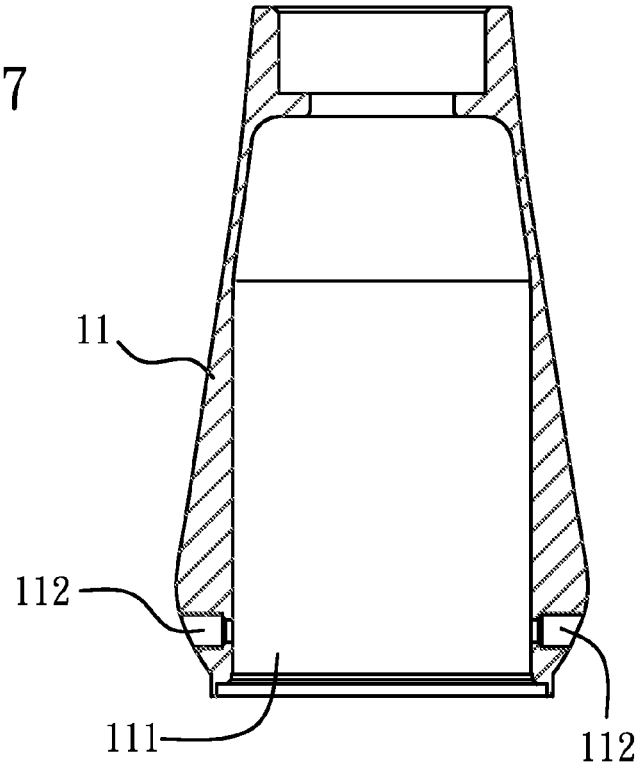
FIG. 18 is a cross sectional view showing the assembly of a housing of a fixing structure of a faucet according to another embodiment of the present invention.

Moreover, another through aperture 112 is provided on another end of an outer surface of the housing 11 as illustrated in FIG. 18 to locate the operating bar 12 at the left side of the support plate 1.

Figure 19:
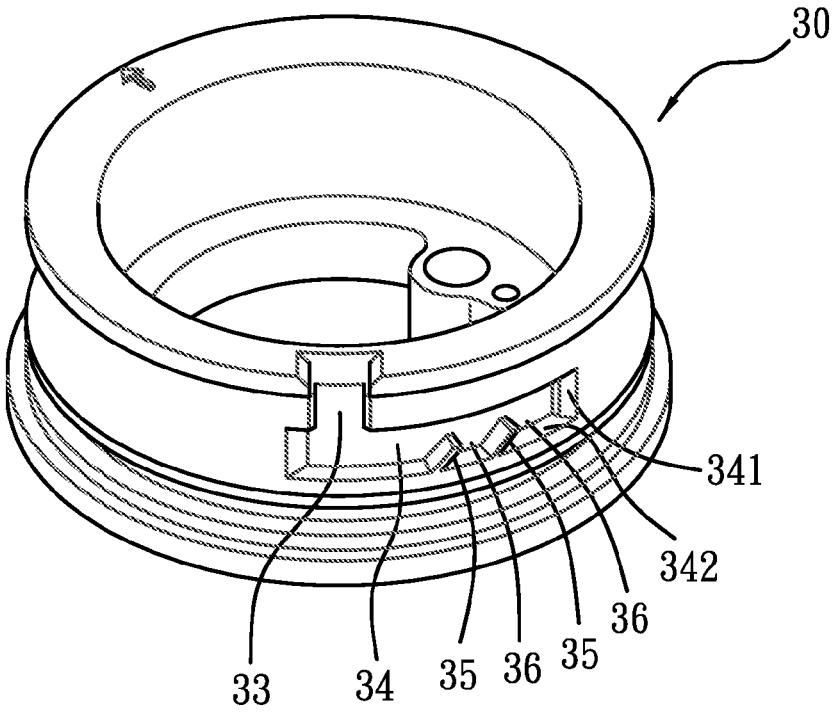
FIG. 19 is a perspective view showing the assembly of a fitting seat of a fixing structure of a faucet according to another embodiment of the present invention.

With reference to FIG. 19, the fitting seat 30 and the teeth 35 in the lateral slot 34 are arranged along a bottom fringe 342 of the lateral slot 34 so that the locking member 20 is retained with one selected retaining recess 36.

Figure 20:
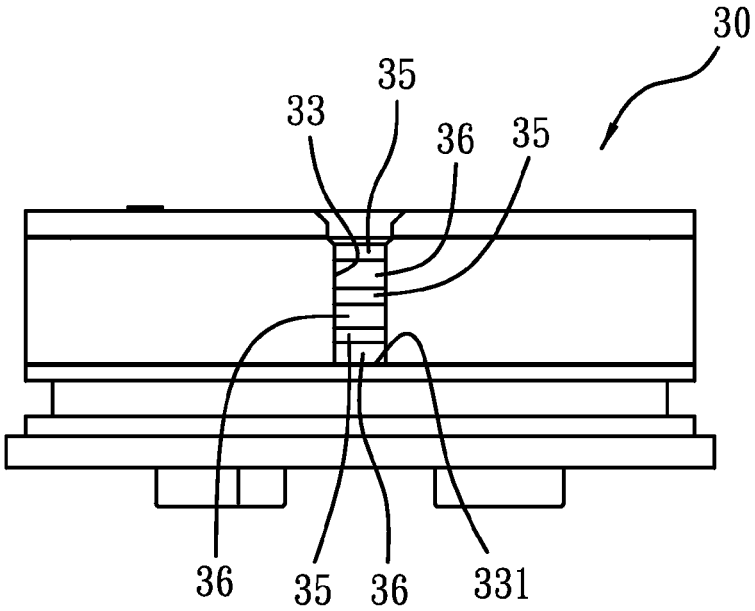
FIG. 20 is a plan view showing the assembly of a fitting seat of a fixing structure of a faucet according to another embodiment of the present invention.

As shown in FIG. 20, the lateral slot 34 is capable of not being provided on the fitting seat 30, e.g., the longitudinal slot 33 only includes a plurality of teeth 35 disposed thereon, among the teeth 35 and a second fence 331 are defined three retaining recesses 36 so that the locking member 20 passes at least one tooth 35 to retain with one selected retaining recess 36, such that after the housing 11 of the faucet 10 is fitted into the fitting seat 30, it is positioned without using one rotating process.

The locking member 20 is installed in the housing 11 in advance and positioned at the disengaging position P1, and after the positioning device 301 is fixed on the support plate 1, the housing 11 is fitted into the fitting seat 30 of the positioning device 301 and is rotated toward a predetermined direction so that the locking member 20 is rotated to pass through the longitudinal slot 33 and slide into the lateral slot 34, thereby positioning the housing 11.

The operating method of the fixing structure of the faucet further comprises removing steps of: moving and limiting the locking member 20 on the disengaging position P2, and lifting the faucet 10 having the housing 11 upward so that the faucet 10 is removed to be maintained and replaced quickly and easily without any rotating operation.

As shown in FIG. 20, the fitting seat 30 is fitted directly during installing the faucet 10, thus positioning the fitting seat 30 quickly and easily without a rotating operation.

The positioning device 301 is capable of being operated on the support plate 1 to position the faucet easily and quickly.

The projections 37 are fixed around an inner surface of the fitting seat 30 and located at the top end of the opening 1*a* of the support plate 1 to arrange the screwing elements 50 and the engagement blocks 60 so that a receiving space of the channel 32 of the fitting seat 30 are increased to insert the inlet pipe unit 13 easily.

Because the tab 612 is located at the middle section of the inner side of the contacting portion 611, the contacting portion 611 of the engagement block 60 is retained on the bottom wall 1*c* of the support plate 1 stably, hence the positioning device 301 is fixed on the support plate 1 securely.

The engagement block 60 is comprised of the metal base 61 and the plastic clamping piece 62 to obtain a strong structure and a tight engaging function, such that the contacting portion 611 contacts with the bottom wall 1*c* of the support plate 1 tightly. Also, the rib 623 of the plastic clamping piece 62 is applied to increase an engagement effect.

While we have shown and described various embodiments in accordance with the present invention, it is clear to those skilled in the art that further embodiments may be made without departing from the scope of the present invention.

What is claimed is:

1. A fixing structure of a faucet fixed on a support plate with an opening and comprising:

the faucet including a housing, the housing including a mouth formed on a bottom end thereof and at least one through aperture radially formed on a peripheral side of the bottom end thereof; the faucet including an inlet pipe unit connected with a bottom end of thereof and extending downward through the mouth of the housing;

a locking member being operated to move between an engaging position and a disengaging position along the through aperture;

a positioning device including a fitting seat, and the fitting seat including a bottom face to be abutted against a top wall of the opening of the support plate, a channel defined therein to receive the inlet pipe unit of the faucet, one slot disposed on least one portion of an outer surface thereof to slide the locking member of the housing located at the engaging position, the slot including at least one tooth and at least one retaining recess such that the locking member passes through the tooth to be retained in the retaining recess and is limited by the tooth to move backward so that the mouth of the housing is fixed on the fitting seat;

the slot includes a longitudinal slot extending axially along the outer surface of the fitting seat and a lateral slot extending along a circumferential direction thereof to communicate with the longitudinal slot, and the lateral slot includes the at least one tooth and the at least one retaining recess so that the locking member longitudinally slides into the longitudinal slot and further rotatable slides into the lateral slot to be retained in the retaining recess of the lateral slot and to be limited by the tooth to rotate backward.

2. The fixing structure of the faucet as claimed in claim 1 further comprising:

two limiting rods being parallel to each other and connected to an inner side of the fitting seat, and a distal end of each limiting rod extending downward to a bottom end of the support plate via the channel;

two screwing elements, each being parallel to a centrally axial line of the fitting seat, inserted into inner side of the fitting seat, and adjacent to the limiting rod, a distal end of the screwing element extending downward to the bottom end of the support plate via the channel;

two engagement blocks, each beings screwed with the screwing element and engaged on a bottom wall of the support plate by using the screw element and the limiting rod so that the fitting seat is fixed on the support plate.

3. The fixing structure of the faucet as claimed in claim 1, wherein the fitting seat is comprised of a first component made of a hard material and a second component made of a plastic material, and the first and the second components are pre-formed, wherein the second component is formed in a C-shaped ring shape so as to be retained in a C-shaped groove pre-formed on an outer surface of the first component; the hard material is a metal to generate a main part of the fitting seat; the second component is used to form main parts of the longitudinal slot and the lateral slot which are at least one tooth of the lateral slot.

4. The fixing structure of the faucet as claimed in claim 1, wherein the through aperture includes threads attached therein, the locking member is a screw bolt to screw with the through hole and to be rotated to move between the engaging and the disengaging positions.

5. The fixing structure of the faucet as claimed in claim 1, wherein the locking member is a pulling shaft on which a resilient element is fitted so that the pulling shaft is acted by the resilient element to be located at the engaging position and is pulled outward to move toward the disengaging position.

6. The fixing structure of the faucet as claimed in claim 1, wherein the lateral slot includes three teeth arranged therein, and between any two adjacent teeth is defined one retaining recess, and between a rearmost tooth and a first fence of a distal end of the lateral slot is defined one retaining recess so that the locking member is selected to be retained with one of the recesses.

7. The fixing structure of the faucet as claimed in claim 2, wherein the fitting seat includes two opposite projections fixed around the inner surface thereof, and each projections includes one limiting rod and one screwing element.

8. The fixing structure of the faucet as claimed in claim 1, wherein the fitting seat includes two the longitudinal slots and two lateral slots provided on two opposite ends of the outer surface thereof respectively; the housing includes one through aperture so that the locking member is selectively retained with one of the teeth of the lateral slot, hence the housing is selectively fixed at one of two circumferential positions.

9. The fixing structure of the faucet as claimed in claim 1, wherein the fitting seat includes one longitudinal slot and one lateral slot provided on one portion of the outer surface thereof; the housing includes two through apertures formed on two opposite sides thereof individually to selectively receive the locking member, and the locking member is retained with the tooth of the lateral slot so that the housing is selectively fixed at one of two circumferential positions.

10. The fixing structure of the faucet as claimed in claim 2, wherein the engagement block is comprised of a metal base and a plastic clamping piece connected on the metal base; the metal base includes a second orifice to screw with the screwing element; the plastic clamping piece engages with the bottom wall of the support plate by using the top wall and the bottom wall of the support plate.

11. The fixing structure of the faucet as claimed in claim 10, wherein he metal base includes a contacting portion and a tab located at a middle section of an inner side of the contacting portion; the contacting portion includes at least one first orifice formed thereon to retain at least one post extending from a bottom end of the plastic clamping piece; the tab includes a second orifice to screw with the screwing element.

12. The fixing structure of the faucet as claimed in claim 10, wherein the plastic clamping piece is semilunar, and includes a notch arranged on a top end thereof and a rib formed around a peripheral side of the top end thereof to engage with the bottom wall of the support plate.

13. The fixing structure of the faucet as claimed in claim 1, wherein the fitting seat further includes two sealing pads attached on the outer and the bottom surfaces thereof individually to engage with an inner surface of the mouth and the top wall of the opening of the support plate.

14. The fixing structure of the faucet as claimed in claim 1, wherein the fitting seat includes a direction remaking element arranged on a top end thereof to guide an installation in a circumferential direction of the fitting seat.

15. An operating method of a fixing structure of a faucet includes steps of:

a. preparing, wherein a faucet, a locking member, and a positioning device are provided;

wherein the faucet includes a housing, the housing includes a mouth formed on a bottom end thereof and at least one through aperture radially formed on a peripheral side of the bottom end thereof; the faucet includes an inlet pipe unit connected with a bottom end of thereof and extending downward through the mouth of the housing;

a locking member is operated to move between an engaging position and a disengaging position along the through aperture;

a positioning device includes a fitting seat, and the fitting seat including a bottom face, a channel defined therein, one slot disposed on least one portion of an outer surface thereof, the slot includes at least one tooth and at least one retaining recess;

b. installing the locking member, wherein the locking member is fixed in a through aperture of a housing so as to move between an engaging and a disengaging positions along the through aperture, thereafter the locking member is controlled to be located the engaging position;

c. positioning the positioning device, wherein a top wall of a fitting seat of the positioning device is retained on the top wall of an opening of a support plate.

d. aligning the faucet, wherein the bottom end of the housing of the faucet is aligned to the fitting seat, and the locking member is aligned with the longitudinal slot; thereafter the inlet pipe unit is inserted into the channel of the fitting seat;

e. fitting the faucet, wherein the bottom end of the housing of the faucet is slidably fitted to the fitting seat, and the locking member slides downward along the longitudinal slot to pass through the al least one tooth to retain with the retaining recess so as to pass the at least one tooth along the lateral slot to retain with one selected retaining recess, hence the locking member is limited so that it can not rotatably return to an original position, thereby positioning the faucet on the positioning device and finishing an installation of the faucet.

16. The operating method of the fixing structure of the faucet as claimed in claim 15, wherein the slot includes a longitudinal slot extending axially along the outer surface of the fitting seat and a lateral slot extending along a circumferential direction thereof to communicate with the longitudinal slot, and the lateral slot includes the at least one tooth and the at least one retaining recess so that the locking member longitudinally slides into the longitudinal slot, is rotated toward a predetermined direction by ways of the step of e, and further rotably slides into the lateral slot to be retained in the retaining recess of the lateral slot and limited by the tooth to rotate backward after the locking member passes through the least one tooth.

17. The operating method of the fixing structure of the faucet as claimed in claim 15, wherein the positioning device further comprises:

two limiting rods being parallel to each other and connected to an inner side of the fitting seat, and a distal end of each limiting rod extending downward to a bottom end of the support plate via the channel;

two screwing elements, each being parallel to a centrally axial line of the fitting seat, inserted into inner side of the fitting seat, and adjacent to the limiting rod, a distal end of the screwing element extending downward to the bottom end of the support plate via the channel;

two engagement blocks, each beings screwed with the screwing element and engaged on a bottom wall of the support plate by using the screw element and the limiting rod so that the fitting seat is fixed on the support plate.

18. The operating method of the fixing structure of the faucet as claimed in claim 17, wherein in the step of c, the screwing elements, the engagement blocks, and the limiting rods are inserted downward from the opening of the support plate until a bottom face of the fitting seat of the fixing device abuts against the top wall of the support plate, and then two head portions of the two screwing elements are individually rotated toward a predetermined direction above the fitting seat by ways of a specific tool so that the adjacent engagement blocks are actuated to rotate so as to leave away from each other, hence the engaging blocks move upward along the screwing elements respectively until they engage with the bottom wall of the support plate.

19. The operating method of the fixing structure of the faucet as claimed in claim 15 further comprising removing steps of: moving and limiting the locking member on the disengaging position, and lifting the faucet having the housing upward so that the faucet is removed.

* * * * *